US011033103B2

(12) United States Patent
Auer

(10) Patent No.: US 11,033,103 B2
(45) Date of Patent: Jun. 15, 2021

(54) DEVICE FOR SETTING A CLOSING POSITION OF A DRAWER, CARCASS RAIL, DRAWER GUIDE, AND DRAWER

(71) Applicant: Grass GmbH, Hoechst (AT)

(72) Inventor: Gabriel Auer, Maeder (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/750,419

(22) Filed: Jan. 23, 2020

(65) Prior Publication Data

US 2020/0237094 A1 Jul. 30, 2020

(30) Foreign Application Priority Data

Jan. 30, 2019 (DE) ..... 10 2019 102 378.5

(51) Int. Cl.
*A47B 88/00* (2017.01)
*A47B 88/427* (2017.01)
*A47B 88/477* (2017.01)

(52) U.S. Cl.
CPC ..... *A47B 88/427* (2017.01); *A47B 88/477* (2017.01)

(58) Field of Classification Search
CPC ..... A47B 88/43; A47B 88/427; A47B 2088/4272; A47B 2088/4274; A47B 2088/4276; A47B 2088/4278; A47B 2210/0054
See application file for complete search history.

(56) References Cited

U.S. PATENT DOCUMENTS 10,470,568 B1 * 11/2019 Chen ..... A47B 88/407
2011/0129171 A1 * 6/2011 Liang ..... A47B 88/427 384/22
2012/0017414 A1 * 1/2012 Cerniglia ..... A47B 88/43 29/428
2012/0292465 A1 * 11/2012 Holzer ..... A47B 88/427 248/201

(Continued)

FOREIGN PATENT DOCUMENTS

AT 515265 A1 7/2015
DE 94 10 504 U1 11/1994

(Continued)

OTHER PUBLICATIONS

European Search Report (Application No. 20151632.5) dated Apr. 17, 2020.

(Continued)

*Primary Examiner* — Matthew W Ing
(74) *Attorney, Agent, or Firm* — Burr & Brown, PLLC

(57) ABSTRACT

A device is provided for adjusting a closing position of a drawer. The device is configured to be attached to a carcass rail such that the closing position of the drawer can be set with respect to a direction of movement of the drawer provided with the rail guide. The device includes a rotatable adjusting element and a stop. When the device is mounted on the furniture, the stop can be brought into different adjustment positions on the device by turning the adjusting element, and the stop predefines the closing position of the drawer. The adjusting element and a sliding element of the device, coupled to the adjusting element, are configured that the sliding element is linearly adjustable by a turning movement of the adjusting element, and the stop is provided on the sliding element.

17 Claims, 6 Drawing Sheets

(56) References Cited

U.S. PATENT DOCUMENTS

| | | | | |
|---|---|---|---|---|
| 2012/0311818 | A1* | 12/2012 | Grabher | E05F 5/02 16/82 |
| 2014/0185968 | A1* | 7/2014 | Langguth | A47B 88/956 384/22 |
| 2014/0314347 | A1* | 10/2014 | Huang | A47B 88/407 384/22 |
| 2015/0230603 | A1* | 8/2015 | Park | A47B 88/473 312/319.1 |
| 2016/0198855 | A1* | 7/2016 | Liang | A47B 88/427 248/241 |
| 2017/0172299 | A1* | 6/2017 | Schneider | F16C 29/001 |
| 2017/0181544 | A1* | 6/2017 | McGregor | A47B 88/427 |
| 2018/0146782 | A1* | 5/2018 | Boekhoff | A47B 88/427 |

FOREIGN PATENT DOCUMENTS

| | | | |
|---|---|---|---|
| DE | 20 2005 006 724 | U1 | 9/2005 |
| DE | 20 2012 012 265 | U1 | 4/2014 |
| DE | 20 2015 107 020 | U1 | 5/2017 |
| WO | 2011/085774 | A1 | 7/2011 |
| WO | 2016/177732 | A1 | 11/2016 |

OTHER PUBLICATIONS

German Search Report (Application No. 10 2019 102 378.5) dated Oct. 9, 2019.

* cited by examiner

DEVICE FOR SETTING A CLOSING POSITION OF A DRAWER, CARCASS RAIL, DRAWER GUIDE, AND DRAWER

This application claims the benefit under 35 USC § 119(a)-(d) of German Application No. 10 2019 102 378.5 filed Jan. 30, 2019, the entirety of which is incorporated herein by reference.

FIELD OF THE INVENTION

The present invention relates to a device for setting a closing position of a drawer, which is accommodated on a furniture carcass, a carcass rail of a drawer guide, a drawer guide for movement guidance of the drawer on the furniture carcass, as well as a drawer.

BACKGROUND OF THE INVENTION

Devices for adjusting, for example, a depth position of a drawer closed on an item of furniture or inserted as far as a system stop, which is accommodated on an extendible rail of a pull-out guide, are known. With an adjusting device, the position of the drawer connected to the rail can be adjusted relative to the rail, in a depth direction, for example.

SUMMARY OF THE INVENTION

The object of the present invention is to provide an adjusting device for a drawer, which, in particular, has a comparatively simple structure and can be operated intuitively.

The present invention starts from a device for adjusting a closing position of a drawer, which is accommodated movably on a furniture carcass of an item of furniture via a rail guide, wherein the rail guide comprises a carcass rail, which can be affixed to the furniture carcass, and a drawer rail, which is displaceable relative to the carcass rail and which can be connected to the drawer, wherein the device is configured for an attachment to the carcass rail in such a manner that the closing position of the drawer can be set with respect to a direction of movement of the drawer provided with the rail guide, wherein the device comprises an adjusting element provided rotatably on the device. The device is, in particular, configured for attachment to a front end of the carcass rail, preferably so that the device is provided adjacent to a front face of the carcass rail and adjacent to a portion of a longitudinal side of the carcass rail adjoining the front face and standing at an angle to the front face. The device is preferably attachable to an angle leg of an attachment angle of the carcass rail aligned horizontally in the installation state at the front end thereof. For this purpose, preferably at least one prepared attachment portion is formed in the carcass rail and/or the device.

The core of the present invention lies in that when the device is mounted on the furniture, a stop of the device can be brought into different adjustment positions on the device by turning the adjusting element, wherein the stop predefines the closing position of the drawer in such a manner that the displacement movement of the drawer rail is limited in the closing direction of the drawer, whereby a counterstop of the drawer rail is present on the stop, wherein the adjusting element of the device and a sliding element of the device coupled to the adjusting element are configured in such a manner that the sliding element is linearly adjustable by a turning movement of the adjusting element, wherein the stop is provided on the sliding element. In each respective adjustment position of the stop, the latter is in a fixed position, wherein the stop or an outer side of the stop acts as a mechanically fixed stop for the counterstop in the closing position and blocks any further movement of the drawer rail in the closing direction.

The device is preferably configured as a plug-on component for detachable attachment to the carcass rail. The sliding element is, for example, a separate component. The adjusting element is mounted rotatably on the device or on the sliding element. The adjusting element and the sliding element are preferably components which can be separated from one another or separate components which can be assembled.

An advantageous depth adjustment of the drawer, which can be used intuitively, is provided with the invention. This is advantageous, for example, when the attachment, e.g. screw-on position of rail guides provided vertically offset above one another for drawers provided above one another on a furniture carcass is not exactly the same. Then, it is usually the case that the front sides of the different drawers project variously far beyond a front face of the furniture carcass when the drawers are closed or are inserted completely on the carcass as far as a system stop. This then results in an unattractive or not completely flat or aligned front image on the furniture. The present invention acts here. For design reasons and/or for technical reasons, it is usually desired that the drawer or the front inner side thereof is not made to abut directly against the furniture body or against the front face thereof when the drawer is closed but to generate a front gap or a small spacing between the inner side of the drawer front and the front face of the furniture carcass. With respectively one device provided according to the present invention, it is advantageously possible to set the depth position of the respective drawer so that the front image of drawer fronts on an item of furniture can be set uniformly flush and/or the front gap can be predefined.

Advantageously, the adjusting element can be adjusted linearly together with the sliding element by turning the adjusting element. The linear movement is forced by the turning movement of the adjusting element. The adjusting element or the axis of rotation thereof, about which the adjusting element can be turned clockwise and counterclockwise, is co-moved during the turning, wherein the axis of rotation of the adjusting element is co-displaced linearly. For this purpose, the adjusting element is accommodated on the sliding element and supported on a base plate of the device. The direction of rotation is readily perceived by an operator as the direction in which the depth position should be adjusted, which advantageously enables an intuitive operation.

Furthermore, it is advantageous that the stop is aligned at an angle to a flat outer side of the sliding element. In particular, a flat stop surface formed by the stop is aligned at an angle or perpendicular to a flat upper side of the sliding element in the installation state. The stop can thus be configured in a space saving manner and advantageously in terms of production technology. The stop is preferably connected in one piece to the remaining sliding element, for example, is provided connected thereon as a bent portion.

According to a preferred variant of the present invention, the device comprises a base plate, which can be plugged on the carcass rail. This is a compact structure. Preferably the sliding element is accommodated linearly adjustably with the adjusting element on the base plate. The displaceability is reversibly possible in two opposite directions parallel to the sliding direction of the drawer rail.

The scope for twisting of the adjusting element and/or the linear movement of the sliding element are preferably limited, in particular, limited in both directions, for example, between end stops.

Another advantageous embodiment of the present invention is distinguished in that the adjusting element has a vertical axis of rotation in the usage state. The axis of rotation is preferably perpendicular to an outer side or to the upper and/or lower side of the sliding element.

It is furthermore proposed that the adjusting element has at least one pivot bearing portion. The pivot bearing portion, e.g. in cylinder form such as a bearing journal, is, for example, accommodated rotatably in a bearing holder in the sliding element, for example, in a round opening in which the bearing journal engages in a circumferentially contacting manner.

The pivot bearing portion is preferably part of a plain bearing arrangement for rotatable mounting of the adjusting element.

According to an advantageous modification of the present invention, the device is constructed from precisely three individual components, comprising the base plate, the adjusting element, and the sliding element. Thus, the device can be produced and assembled or dismantled easily. Preferably the components consist of a plastic and/or metal material.

An advantage with regard to the attachment lies in that the device has a resilient plug-in portion for plugging the device on the carcass rail. With the plug-in portion, which preferably comprises a resilient engaging member, an independently snap-in attachment is possible, which can be easily cancelled again as a result of the spring property of the plug-in portion. The resilient plug-in portion is, for example, configured for plugging the device on a front end portion of the carcass rail. The plugging-in with a resilient action on the carcass rail is preferably accomplished on the horizontal leg of the carcass rail. In this case, a front edge of the leg and/or a longitudinal edge of the leg adjoining the front edge of the leg is embraced by the resilient plug-in portion. The resilient plug-in portion preferably has a hook contour or a hook portion for detachable hooking onto a mating contour of the carcass rail. The mating contour of the carcass rail is preferably a recess or indentation in the material of the carcass rail with an edge of the recess, wherein a portion of the hook portion is present at the edge in the hooked or engaged state.

An advantage is obtained whereby the device has a height dimension between 3 and 7 millimeters, preferably of around 5 millimeters.

With regard to the installation space, it is advantageous if the device has a length dimension between 20 and 50 millimeters, preferably of around 35 millimeters. A width dimension of the device directed transversely to the length dimension preferably lies in the order of magnitude of the length dimension.

Another advantage lies in the fact that the adjusting element and the base plate comprise transmission portions, which come into mutual abutment, which are configured for conversion of the turning movement of the adjusting element into the linear movement of the sliding element. The transmission portions are preferably provided on the device concealed toward the outside at least for the most part or covered toward the outside by portions of the base plate or the adjusting element and the sliding element. The transmission portions comprise, for example, a screw arrangement and/or an eccentric arrangement. The type of movement is converted into both directions of rotation of the adjusting element so that depending on the direction of rotation, the sliding element is displaceable linearly to and fro.

Furthermore, an advantage can be seen in the fact that the transmission portions comprise a protruding engaging member and a recessed guide portion, wherein the engaging member projects into the guide portion. Preferably the engaging member is spiral or bent, e.g. formed on an underside of the adjusting element. The engaging member is, in particular, a web which protrudes toward adjacent portions, e.g. bent in a spiral shape or in a screw shape.

The present invention furthermore extends to a carcass rail of a rail guide, in particular, of a drawer guide, wherein the carcass rail comprises a device as claimed in one of the previously described variants.

The carcass rail comprises, for example, an attachment angle with flat angle legs aligned at right angles to one another, wherein a first or vertical angle leg can be screwed on an inner side of the furniture carcass and another angle leg points in a projecting manner into the interior of the furniture carcass. The device according to the present invention can easily be releasably attached to the further or horizontal angle leg.

The rail guide additionally comprises a rail or a drawer rail which is displaceable relative to the carcass rail and which can be connected to the drawer. The drawer rail preferably has a mechanical stop such as a system stop, which forms the counterstop for the stop of the device and acts between the carcass rail and the drawer rail and predefines the relative position of the two rails when the drawer rail is pushed in. The mating portion is formed integrally on the drawer rail or is provided as a separate attachment part thereon.

The present invention also relates to a rail guide, in particular, a drawer guide with a carcass body formed as described above and having a drawer rail, which is displaceable relative to the carcass rail and which can be connected to a drawer.

Finally, the present invention extends to a drawer with a rail guide, which is configured as mentioned above.

BRIEF DESCRIPTION OF THE DRAWINGS

Further features and advantages of the present invention are explained in detail hereinafter with reference to schematically depicted exemplary embodiments according to the present invention.

DETAILED DESCRIPTION OF THE INVENTION

Figure 1:
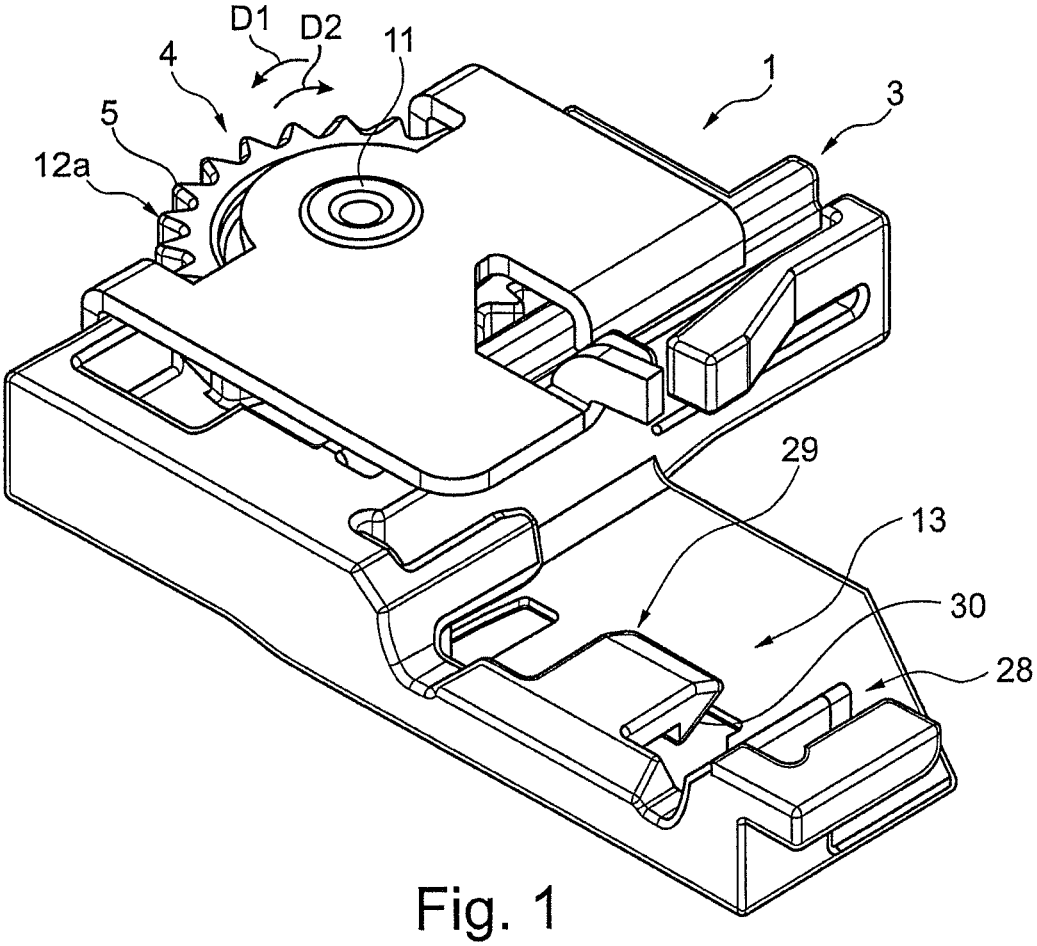
FIG. 1 shows an exemplary embodiment of a device according to the present invention in perspective view obliquely from above.
Figure 2:
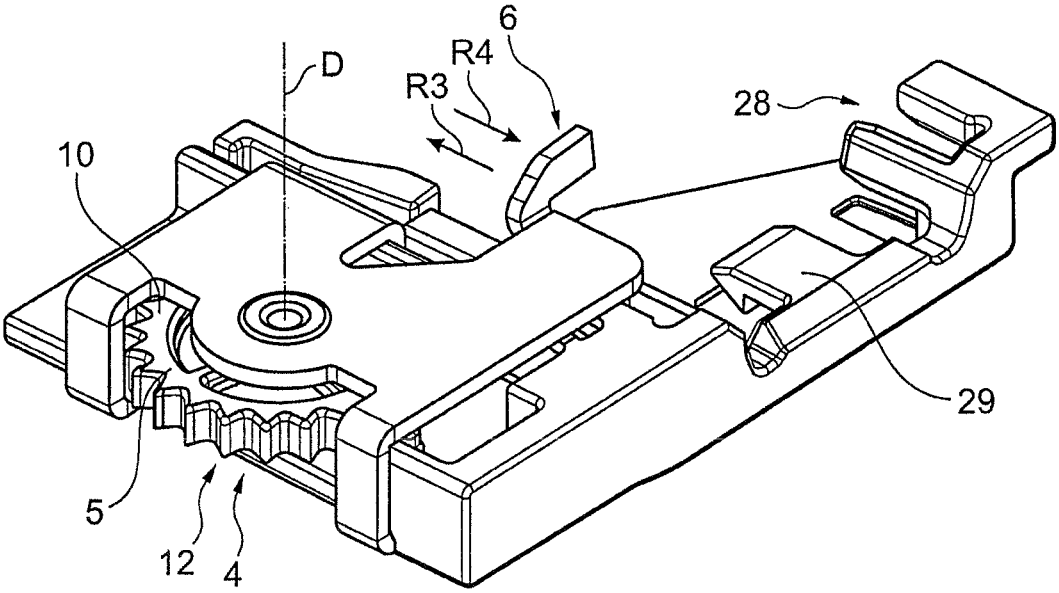
FIG. 2 shows the device according to FIG. 1 in a further perspective view obliquely from above.
Figure 3:
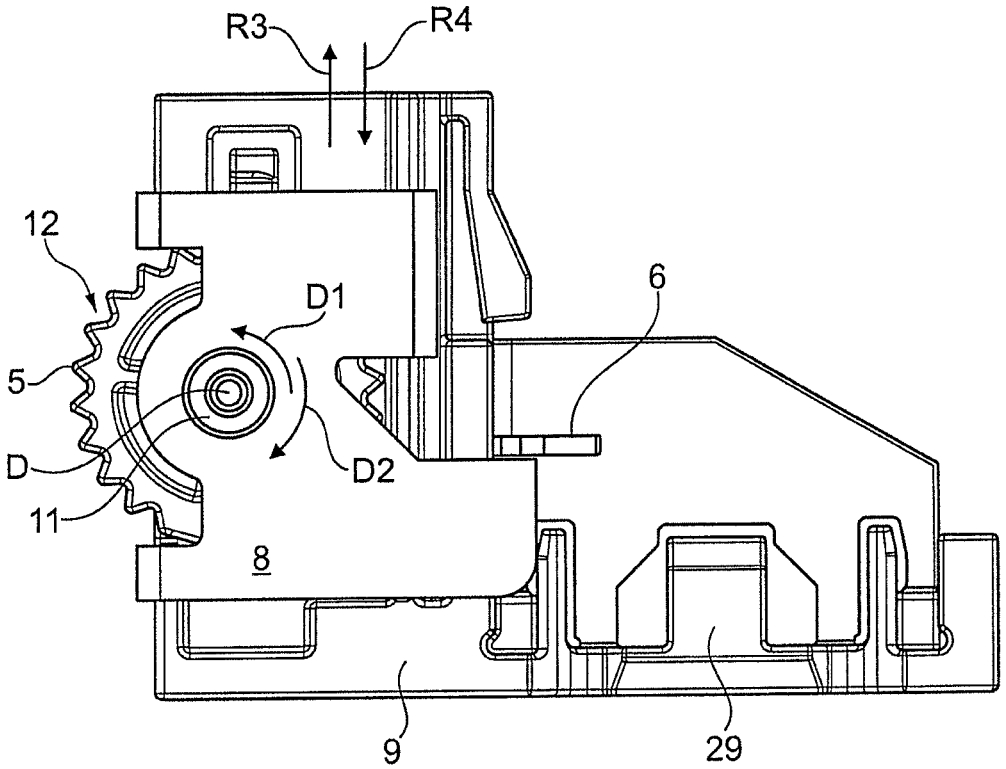
FIG. 3 shows the device according to FIGS. 1 and 2 from above.
Figure 4:
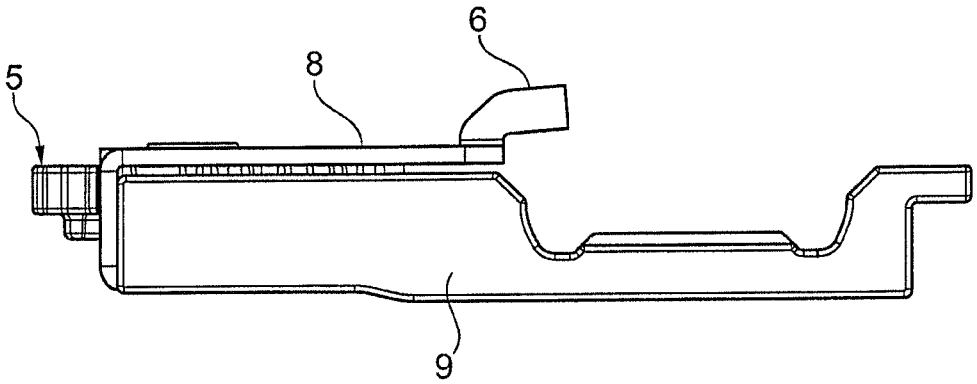
FIG. 4 shows the device according to FIGS. 1-3 in a front view.

FIGS. 1 to 6 show in various views a device 1 according to the present invention for setting a closing position of a drawer 38 (see FIG. 11), when this is accommodated movably via a guide rail 2 (see FIGS. 7-11) on a furniture carcass of an item of furniture 32.

The device 1 is configured as a drawer depth adjusting device 3 and comprises an adjusting element 4 provided rotatably on the device 1, which is configured as an adjusting wheel 5. By manual rotation of the adjusting wheel 5 in the direction D1 or in the direction D2 about a vertical axis of rotation D in the usage state, a linearly adjustable stop 6 of the device 1 is brought into different fixed adjusting positions on the device 1 and therefore on the rail guide 2.

The stop 6 predefines the closing position of the drawer, wherein a displacement movement of a drawer rail 22 of the rail guide 2 in a closing direction R2 of the drawer 38 is limited. In this case, a counterstop 7 of the drawer rail 22 is present at the stop 6 which is set predefinably via the adjusting wheel 5. The maximum possible displacement path of the stop 6 is, for example, up to 5 or 10 or 15 millimeters.

In an opening direction R1 of the drawer rail 22, the stop 6 does not form an obstacle, wherein portions of the drawer rail 22 pass above or possibly to the side of the stop 6 over the longitudinal extension thereof.

The adjusting wheel 5 and a sliding element 8 of the device coupled to the adjusting wheel 5 are configured in such a manner that as a result of a turning movement of the adjusting wheel 5 in one of the directions of rotation D1 or D2, the sliding element 8 and therefore the stop 6 are adjustable linearly in the direction R3 or in the direction R4. The directions R3 and R4 are aligned parallel to the direction of displacement provided with the rail guide 2 or opening direction R1 and closing direction R2 of the drawer 38. The stop 6 is provided on the sliding element 8 in one piece or as a separate part thereon.

The device 1 additionally comprises a base plate 9. The base plate 9 is configured in such a manner that the base plate 9 and therefore the device 1 can be plugged onto a carcass rail 21, which can be attached in a fixed position on the furniture 32 or on a side wall 34 of the furniture 32. Thus, in the usage state of the device 1 the base plate 9 is immovable relative to the furniture 32.

The adjusting wheel 5 has a disk portion 10 (see FIG. 2) and an upper-side outer-cylindrical pivot bearing section 11 relative to the installed state. The pivot bearing section 11 projects or protrudes on an appurtenant upper side of the disk portion 10 centrally and transversely thereto. An operating portion 12 for a manual twisting of the adjusting wheel 5, which is provided on the outer circumference on the disk portion 10 and is configured, for example, as a toothed contour 12*a*, enables a secure manual and continuous twisting of the adjusting wheel 5.

Furthermore, the device 1 has a resilient plug-in portion 13, which is used for the correct-position plugging-in and/or detachable securing of the device 1 on the carcass rail 21.

The adjusting wheel 5 is additionally co-moved during twisting linearly relative to the base plate 9 jointly with the sliding element 8. For this purpose, the adjusting wheel 5 and the base plate 9 have transmission portions 14, 15, which come into mutual abutment. The transmission portions 14, 15 force a linear movement of the sliding element 8 simultaneously or in a superposed manner with the turning movement of the adjusting wheel 5. The transmission portions 14 pertain to the adjusting wheel 5 and the transmission portions 15 pertain to the base plate 9.

The transmission portion 14 is provided on the adjusting wheel 5 on the underside of the disk portion 10 relative to the installed state. The transmission portion 14 comprises a bent elongate engaging member 16 which projects toward the relevant underside of the disk portion 10, which engaging member is configured as a screw-like spiral web 17. Thus, a different spacing of the respective position with respect to the axis of rotation D is predefined over the course of the web 17 at each point of the web 17.

The transmission portion 15 on the base plate 9 comprises a recessed guide portion 18, which is formed between two adjacent and spaced-apart, elevated guide sockets 19 and 20.

The engaging member 16 or a portion of the web 17 projects between the guide sockets 19 and 20, so that a comparatively short longitudinal portion of the web 17 is positioned on or in the guide portion 18 between the two guide sockets 19 and 20, wherein depending on the rotational position of the adjusting wheel 5, respectively one different longitudinal portion of the web 17 comes to abut with respectively one side in between, on respectively one side of the two guide sockets 19 and 20 directed toward the guide portion 18.

Thus, the position of the adjusting wheel 5 and therefore of the stop 6 in adjusting direction R3 or R4 will be predefined depending on the rotational position of the adjusting wheel 5.

Figure 5:
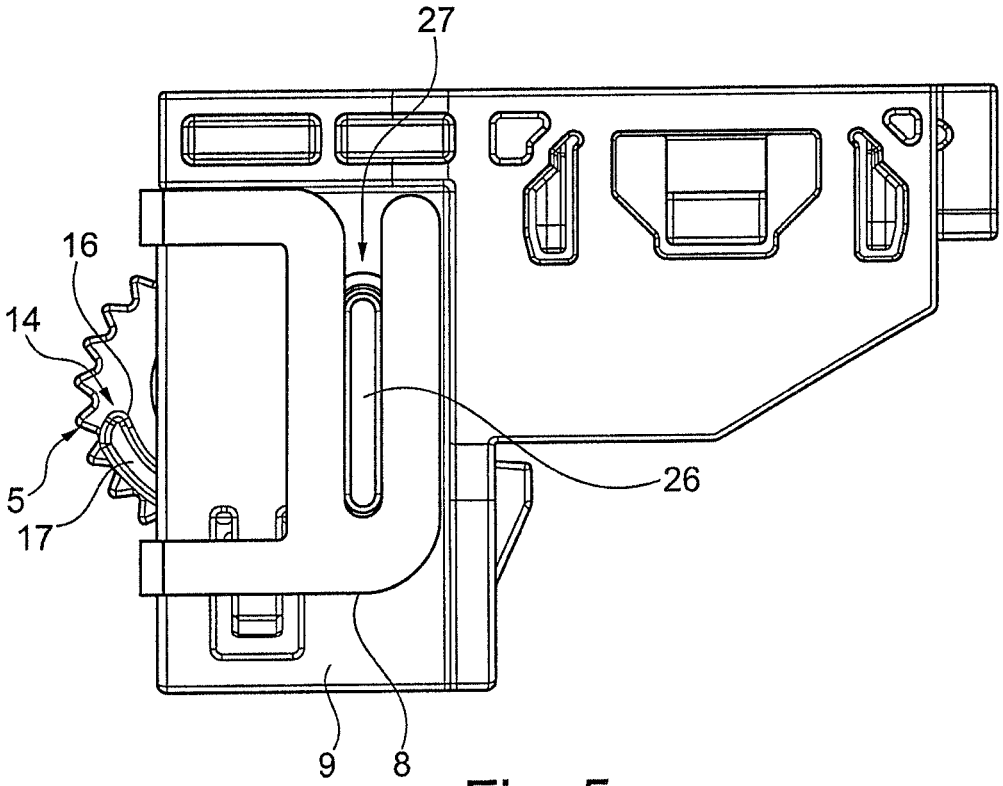
FIG. 5 shows the device according to FIGS. 1-4 from below.
Figure 6:
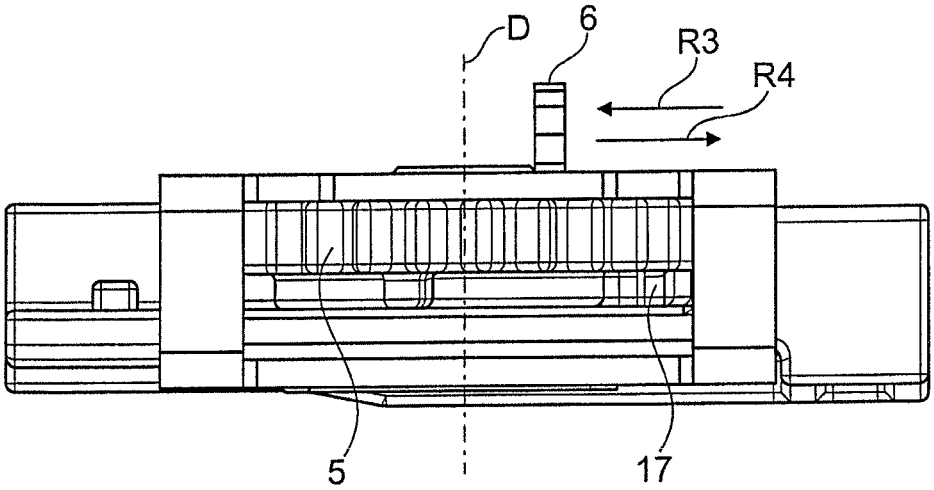
FIG. 6 shows the device according to FIGS. 1-5 in a side view.

For linear guidance of the sliding element 8 on the base plate 9, a straight web 26 is provided on the underside of the base plate 9, which engages suitably in a slot 27 in the sliding element 8 (see FIG. 5). The sliding element 8 is U-shaped with an upper leg, which partially covers the base plate 9 at the top and with a lower leg having the slot 27, wherein the lower leg partially covers the base plate 9 at the bottom.

A resilient engaging member 29 of the plug-in portion 13 is formed on the base plate 9 for plugging the device 1 on the carcass rail 21. With the plug-in portion 13 or the engaging member 29, an independently snap-in and re-detachable attachment of the device 1 to the carcass rail 21 or to an attached portion on the horizontal leg 25 of the carcass rail 21 is possible. A hook portion 30 of the engaging member 29 thereby engages in a suitable recess 31 on the carcass rail 21 or on the portion which can be connected to the horizontal leg 25.

A slot-shaped grip portion 28 on the base plate 9, which embraces a web on the carcass rail 21 in the plugged-in state of the device 1, additionally serves for correct positioning of the device 1 on the rail guide 2.

The rail guide 2 comprises the carcass rail 21, which can be fastened to the furniture 32, and the drawer rail 22, which is displaceable relative to the carcass rail 21 and which can be connected to the drawer 38, a central rail acting therebetween when fully extended. The counterstop 7 is formed on the front-side, front end of the drawer rail 22 in the opening direction R1, e.g. a sheet-metal plate which is open at the bottom, which comes to abut with its inner side against a front side of the stop 6 when the drawer 38 is closed.

An attachment angle 23 of the carcass rail 21 has a vertical leg 24 and the horizontal leg 25 projecting at right angles thereto. The vertical leg 24 is penetrated by screw-in openings 41, which are used for screwing the carcass rail 21 on respectively one inner side of the side walls 34 using screw means.

Figure 7:
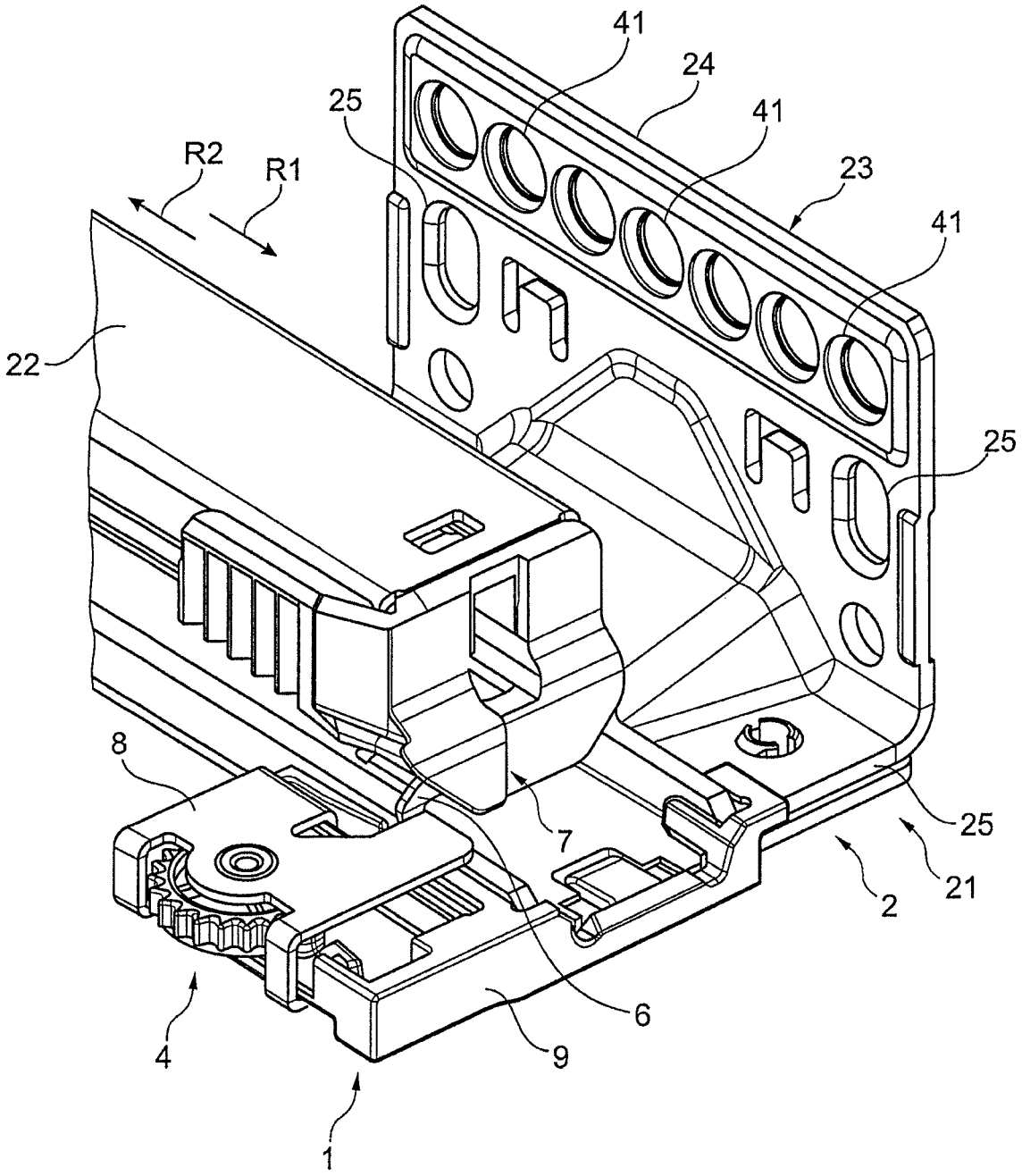
FIG. 7 shows the device according to FIGS. 1-6 in the attached state on a partially depicted rail guide in a perspective view obliquely from above.
Figure 8:
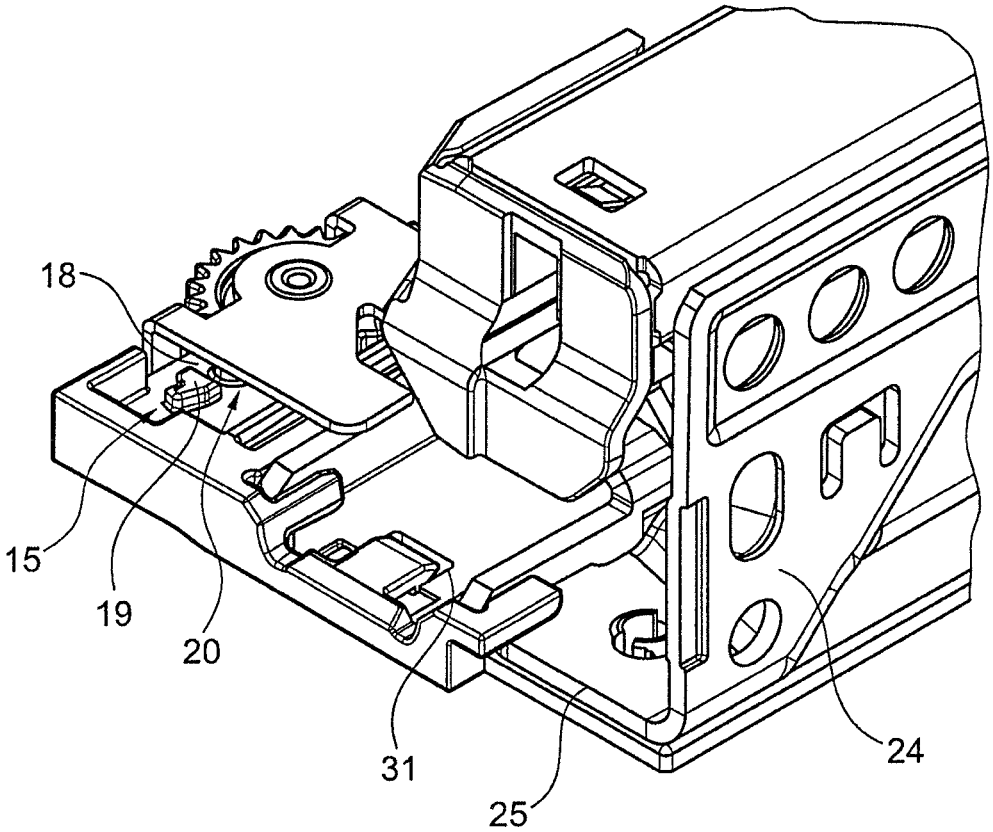
FIG. 8 shows a section of the arrangement according to FIG. 7 in a further perspective view obliquely from above.
Figure 9:
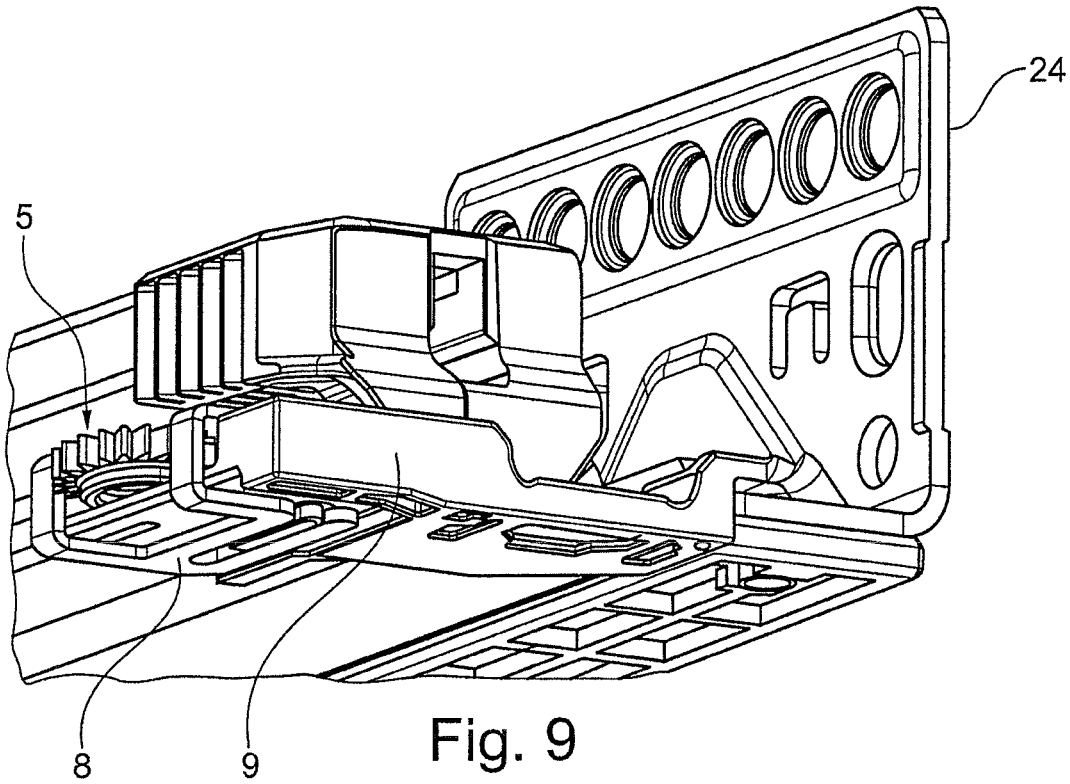
FIG. 9 shows the arrangement according to FIG. 7 in a further perspective view obliquely from below.
Figure 10:
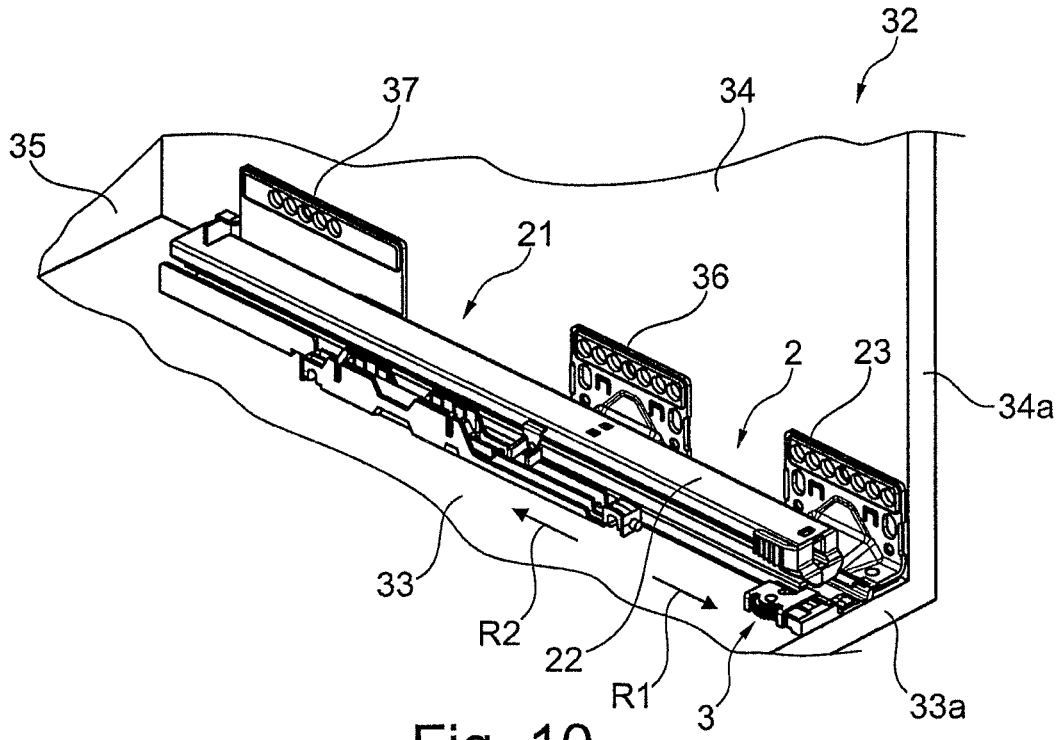
FIG. 10 shows a section of an item of furniture with the rail guide according to the present invention attached thereon in perspective view.

FIG. 10 shows a section of the furniture 32 with the rail guide 2 according to the present invention attached thereon with the drawer depth adjusting device 3 according to FIGS. 7 to 9 in perspective view. Of the furniture 32, a base 33, the side wall 34, and a rear wall 35 can each be seen in sections. Screw means, by means of which the attachment angle 23 and two further attachment angles 36 and 37 of the carcass rail 21 of the rail guide 2 are screwed to the side wall 34 on the inner side are not shown. The rail guide 2 with the drawer depth adjustment device 3 is installed with its front end flush with respect to a front-side face 34*a* of the side wall 34 and with respect to a front-side face 33*a* of the base 33.

Figure 11:
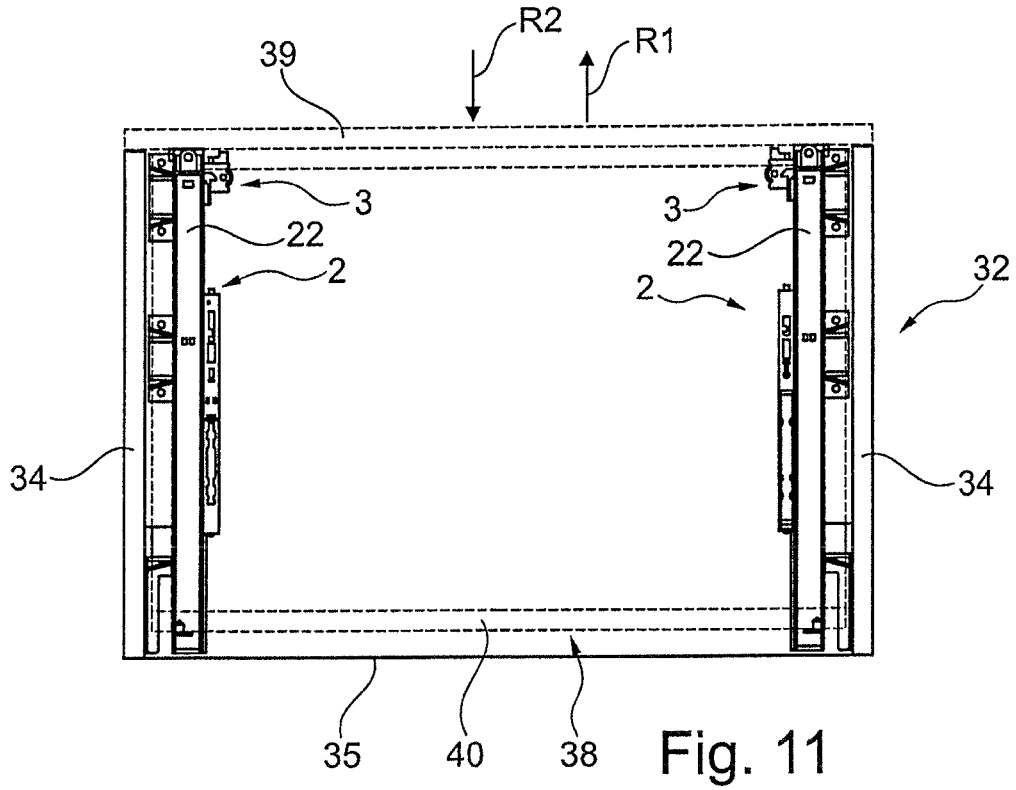
FIG. 11 shows a view from above of an item of furniture with two drawer guides according to the present invention for a drawer which can be attached thereto, which is not shown or of which component edges are indicated by dotted lines.

FIG. 11 shows the furniture 32 according to FIG. 10 from above without an upper base comprising two opposite side walls 34 with two rail guides 2 suitably constructed according to the present invention each having a drawer depth adjustment device 3. Of the drawer 38, which can be accommodated thereon or which can be placed from above obliquely thereon with a drawer front 39 and a drawer rear wall 40, only component edges are indicated by dotted lines.

REFERENCE LIST

1 Device
2 Rail guide
3 Drawer depth adjusting device
4 Adjusting element
5 Adjusting wheel
6 Stop
7 Counterstop
8 Sliding element
9 Base plate
10 Disk portion
11 Pivot bearing portion
12 Operating portion
12*a* Toothed contour
13 Plug-in portion
14 Transmission portions
15 Transmission portion
16 Engaging member
17 Web
18 Guide portion
19 Guide socket
20 Guide socket
21 Carcass rail
22 Drawer rail
23 Attachment angle
24 Vertical leg
25 Horizontal leg
26 Web
27 Slot
28 Engaging portion
29 Snap-in element
30 Hook portion
31 Recess
32 Furniture
33 Base
33*a* Face
34 Side wall
34*a* Face
35 Rear wall
36 Attachment angle
37 Attachment angle
38 Drawer
39 Drawer front
40 Drawer rear wall
41 Screw-in opening

The invention claimed is:

1. A device for adjusting a closing position of a drawer, which is accommodated movably on a furniture carcass of an item of furniture via a rail guide, wherein the rail guide comprises a carcass rail, which can be affixed to the furniture carcass, and a drawer rail, which is displaceable relative to the carcass rail and which can be connected to the drawer, wherein the device is configured for an attachment to the carcass rail in such a manner that the closing position of the drawer can be set with respect to a direction of movement of the drawer provided with the rail guide, wherein the device comprises an adjusting element provided rotatably on the device, wherein when the device is mounted on the furniture, a stop of the device can be brought into different adjustment positions on the device by turning the adjusting element, wherein the stop predefines the closing position of the drawer in such a manner that the displacement movement of the drawer rail is limited in the closing direction of the drawer, whereby a counterstop of the drawer rail is present on the stop, wherein the adjusting element of the device and a sliding element of the device coupled to the adjusting element are configured in such a manner that the sliding element is linearly adjustable by a turning movement of the adjusting element, wherein the stop is provided on the sliding element.

2. The device as claimed in claim 1, wherein the adjusting element can be adjusted linearly together with the sliding element by turning the adjusting element.

3. The device as claimed in claim 1, wherein the stop is aligned at an angle to a flat outer side of the sliding element.

4. The device as claimed in claim 1, wherein the device comprises a base plate, which can be plugged on the carcass rail.

5. The device as claimed in claim 1, wherein the adjusting element has a vertical axis of rotation in the usage state.

6. The device as claimed in claim 1, wherein the adjusting element has at least one pivot bearing portion.

7. The device as claimed in claim 1, wherein the device is constructed from precisely three individual components, comprising a base plate, the adjusting element, and the sliding element.

8. The device as claimed in claim 1, wherein the device has a resilient plug-in portion for plugging the device on the carcass rail.

9. The device as claimed in claim 1, wherein the device has a height dimension between 3 mm and 7 mm.

10. The device as claimed in claim 1, wherein the device has a length dimension between 20 mm and 50 mm.

11. The device as claimed in claim 7, wherein the adjusting element and the base plate comprise transmission portions, which come into mutual abutment, which are configured for conversion of the turning movement of the adjusting element into the linear movement of the sliding element.

12. The device as claimed in claim 11, wherein the transmission portions comprise a protruding engaging member and a recessed guide portion, wherein the engaging member projects into the guide portion.

13. A carcass rail of a rail guide, wherein the carcass rail comprises a device as claimed in claim 1.

14. A rail guide with a carcass rail as claimed in claim 13 and a drawer rail, which is displaceable relative to the carcass rail and which can be connected to a drawer.

15. A drawer with a rail guide as claimed in claim 14.

16. The device as claimed in claim 9, wherein the height dimension of the device is around 5 mm.

17. The device as claimed in claim 10, wherein the length dimension of the device is around 35 mm.

* * * * *